US007291038B2

(12) United States Patent
Tadokoro

(10) Patent No.: US 7,291,038 B2
(45) Date of Patent: Nov. 6, 2007

(54) CONNECTOR AND PRINTED CIRCUIT BOARD CONNECTED TO THE SAME

(75) Inventor: Asami Tadokoro, Machida (JP)

(73) Assignee: Semiconductor Energy Laboratory Co., Ltd., Kanagawa-ken (JP)

( * ) Notice: Subject to any disclaimer, the term of this patent is extended or adjusted under 35 U.S.C. 154(b) by 0 days.

(21) Appl. No.: 11/405,515

(22) Filed: Apr. 18, 2006

(65) Prior Publication Data

US 2006/0240700 A1 Oct. 26, 2006

(30) Foreign Application Priority Data

Apr. 25, 2005 (JP) ..... 2005-126769

(51) Int. Cl.
*H01R 12/24* (2006.01)

(52) U.S. Cl. ..... 439/493; 439/404

(58) Field of Classification Search ..... 439/493, 439/498, 499, 492, 329, 404, 405, 387, 67, 439/752, 695

See application file for complete search history.

(56) References Cited

U.S. PATENT DOCUMENTS 5,209,672 A * 5/1993 Hatanaka ..... 439/157
6,033,238 A 3/2000 Fogg et al.
6,368,148 B1 4/2002 Fogg et al.
6,638,100 B2 10/2003 Fogg et al.
2003/0064615 A1 4/2003 Fogg et al.

FOREIGN PATENT DOCUMENTS

JP 10-335013 12/1998
JP 11-251007 9/1999

* cited by examiner

*Primary Examiner*—Javaid H. Nasri
(74) *Attorney, Agent, or Firm*—Eric J. Robinson; Robinson Intellectual Property Law Office, P.C.

(57) ABSTRACT

A connector capable of electrically connecting a printed circuit board to a flat cable without soldered connections. Each of a plurality of first connecting terminals provided at a first housing has a portion that sandwiches a predetermined conductor through an insulating coating of a flat cable and crimps the conductor. The first connecting terminals pass through holes provided in a cover. The first connecting terminals are brought into contact with conductive portions of a printed circuit board and electrically connected to the conductive portions. The printed circuit board has a wiring pattern one end of which is connected to a PCI card edge connector and the other end is connected to a through hole. Accordingly, the PCI card edge connector is electrically connected to the conductive portions of the flat cable through the first connecting terminals.

28 Claims, 9 Drawing Sheets

CONNECTOR AND PRINTED CIRCUIT BOARD CONNECTED TO THE SAME

BACKGROUND OF THE INVENTION

1. Field of the Invention

The present invention relates to a connector and a printed circuit board connected to the connector. In particular, the invention relates to a connector for flat cable that is capable of connecting a flat cable to a printed circuit board without soldered connections, and a printed circuit board connected to the connector 2. Description of the Related Art Most of the conventional connectors for flat cable are used as a male or female connector through a pitch conversion substrate by crimping a conductor of a flat cable to a plurality of terminals incorporated in a housing.

For example, there is a mode where a plurality of signal contacts and ground buses are arranged in parallel to each other in the longitudinal direction of a housing and each of the ground buses has a ground conductor crimping slot that is programmed in advance and a bypass slot (see Patent Document 1).

[Patent Document 1] Japanese Patent Laid-Open No. H10-335013

Patent Document 1 discloses a mode where a bypass slot accepts a signal conductor of a flat cable without crimping, and after the completion of crimping and termination, the signal conductor of a flat cable and a ground conductor are arranged on the same surface.

There is another mode where a plurality of holes are provided at one end of a housing, a hole communicated with the holes in common is provided at the other end, and terminals are inserted into these holes (see Patent Document 2).

[Patent Document 2] Japanese Patent Laid-Open No. H11-251007

Patent Document 2 discloses a mode where each terminal has a crimping slit part in a hole side and a male contact part to be brought into contact with a terminal of a counterpart connector, the center positions of the terminals are arranged so that the arrangement pitches of the crimping slit parts are different from the arrangement pitches of the contact parts, the crimping slit parts and the contact parts of the terminals are formed like flat plates, and the mutually connecting parts of the crimping slit parts and the contact parts are curved so as to be parallel to each other and overlap in steps.

Such a conventional connector for flat cable requires a receiving jig such as a socket at a circuit board side to be connected. As another mode, soldered connection is required to connect a connector pin to a circuit board to be connected. In the case of soldered connection, the use of a material containing a biologically and environmentally harmful substance tends to be restricted, and it is required to review components and usage of solder that is a mixture of tin and lead.

In addition, it is important to reduce the number of mounted components and mount operations of a connector in order to achieve shorter delivery times and cost savings in view of the mass production process.

SUMMARY OF THE INVENTION

In view of the foregoing, the invention provides a connector that is capable of connecting a flat cable to a printed circuit board by a simple method. In particular, the invention provides a connector that is capable of connecting a flat cable to a printed circuit board without soldered connections.

In view of the aforementioned problems, the invention provides a connector for connecting a flat cable to a printed circuit board, wherein a connecting terminal included in a housing has a length equal to or longer than the thickness of the printed circuit board, and the connecting terminal passes through the flat cable and the printed circuit board so as to be electrically connected thereto. The housing for receiving the connecting terminal is rounded so as to roll and store the end of the connecting terminal. Such a housing is called a guiding means.

The invention is specifically described below.

According to one mode of the invention, a connector has a housing including a plurality of first connecting terminals provided at a plurality of points in orthogonal to the longitudinal direction of the flat cable and each capable of being connected to at least a part of the plurality of conductors, and a cover including holes for holding the first connecting terminals, wherein the first connecting terminals sandwich a predetermined conductor through the insulating coating of the flat cable and are crimped to the conductor. In this specification, electrical connection by applying pressure is referred to as crimping.

According to another mode of the invention, a connector has a first housing including a plurality of first connecting terminals provided at a plurality of points in orthogonal to the longitudinal direction of the flat cable and each capable of being connected to at least a part of the plurality of conductors, a cover including holes for holding the first connecting terminals, and a second housing including a plurality of depressed portions for receiving the ends of the first connecting terminals, wherein each of the first connecting terminals sandwiches a predetermined conductor through the insulating coating of the flat cable so as to be crimped to the conductor.

According to another mode of the invention, a connector has a first housing including a plurality of first connecting terminals provided at a plurality of points in orthogonal to the longitudinal direction of the flat cable and each capable of being connected to at least a part of the plurality of conductors, a cover including holes for holding the first connecting terminals, and a second housing including a plurality of depressed portions for receiving the ends of the first connecting terminals, wherein each of the first connecting terminals sandwiches a predetermined conductor through the insulating coating of the flat cable so as to be crimped to the conductor, and when the first connecting terminals are put in the depressed portions of the second housing, the first connecting terminals are deformed to be in contact with a conductive portion of a printed circuit board and electrically connected to the conductors of the flat cable crimped to the first connecting terminals.

According to another mode of the invention, a connector has a first housing including a plurality of first connecting terminals provided at a plurality of points in orthogonal to the longitudinal direction of the flat cable and each capable of being connected to at least a part of the plurality of conductors, a cover including holes for holding the first connecting terminals, a second housing including a plurality of depressed portions for receiving the ends of the first connecting terminals, and a printed circuit board including a plurality of conductive portions provided at the same interval as the first connecting terminals, wherein each of the first connecting terminals sandwiches a predetermined conductor through the insulating coating of the flat cable so as to be crimped to the conductor, and when the first connecting terminals are put in the depressed portions of the second housing, the first connecting terminals are deformed to be in contact with the conductive portions of the printed circuit board, and the conductor of the flat cable crimped to the first connecting terminals is electrically connected to each signal line of a PCI (Peripheral Components Interconnect) card edge connector.

According to the invention, the PCI card edge connector can be electrically connected to the flat cable without soldered connections.

In the invention, the second housing may have a guiding means for guiding the direction to which the first connecting terminals are deformed when the first connecting terminals are put in, namely for controlling so as to deform the first connecting terminals.

According to the invention having such a structure, when the ends of the first connecting terminals are brought into contact with the depressed portions over the second housing, the depressed portions over the second housing can be prevented from being damaged and the ends of the first connecting terminals can be guided to be deformed safely. As a result, the first connecting terminals can be electrically connected to the conductive portion of the printed circuit board certainly.

In the invention, a printed circuit board may have a pattern capable of mounting a buffer IC (Integrated Circuit), one end of which is connected to each signal line of a PCI card edge connector and the other end is connected to an opening that includes a copper-plated lateral side (hereinafter referred to as a through hole) crimped to each first connecting terminal.

According to such a structure of the invention for connecting a buffer IC, connection to an object can be carried out correctly even in the case where data transfer drive capability is excess or insufficient.

According to the invention, a printed circuit board is printed with a wiring pattern, and has a through hole that includes a copper-plated lateral side and is provided so that a first connecting terminal of a first housing passes therethrough. The printed circuit board is connected to a connector that has a plurality of conductors arranged in accordance with the position of the through hole, a flat cable including an insulating coating for covering the conductors, a cover including a hole for holding the first connecting terminal, and a second housing including a plurality of depressed portions for receiving the end of the first connecting terminal. The conductors are electrically connected to the wiring pattern with the first connecting terminal of the connector.

According to another mode of the invention, a printed circuit board is printed with a wiring pattern, and has a through hole that includes a copper-plated lateral side and is provided so that a first connecting terminal of a first housing passes therethrough. The printed circuit board is connected to a connector that has a plurality of conductors arranged in accordance with the position of the through hole, a flat cable including an insulating coating for covering the conductors, a cover including a hole for holding the first connecting terminal, and a second housing including a plurality of depressed portions for receiving the end of the first connecting terminal. The first connecting terminal of the connector sandwiches a predetermined conductor through the insulating coating of the flat cable so as to be crimped to the conductor, whereby the conductors are electrically connected to the wiring pattern.

As set forth above, the invention can provide a printed circuit board connected to a connector.

According to the invention, an electronic device has a first housing including a plurality of first connecting terminals at a first surface, a second housing including a plurality of depressed portions for receiving ends of the first connecting terminals at a second surface, a cover including a hole for holding the first connecting terminals, a flat cable, and a printed circuit board including a through hole capable of being passed therethrough the first connecting terminals, wherein the first connecting terminals are electrically connected to at least a part of a plurality of conductors covered by an insulating coating and arranged in parallel with each other along a longitudinal direction of the flat cable, wherein the first connecting terminals sandwich the plurality of conductors through the insulating coating of the flat cable and crimp the plurality of conductors, wherein the first connecting terminals are provided in a longitudinal direction of the first housing which is orthogonal to the longitudinal direction of the flat cable, wherein the first connecting terminals are provided at an equal interval, wherein the first surface of the first housing and the second surface of the second housing are faced to each other with the cover, the flat cable, and the printed circuit board interposed therebetween, and wherein a wiring pattern on the printed circuit board is electrically connected to the plurality of conductors of the flat cable through the first connecting terminals.

According to the invention, a flat cable and a printed circuit board can be connected, namely crimped to each other without a receiving jig such as a socket on the circuit board side to be connected. As a result, connection between a flat cable and a printed circuit board can be completed by a simple step. Further, according to the invention, a flat cable and a printed circuit board can be electrically connected to each other without soldered connections. As a result, a soldering step can be omitted. Thus, according to the invention, the number of mounted components can be reduced.

DETAILED DESCRIPTION OF THE INVENTION

Figure 1A:
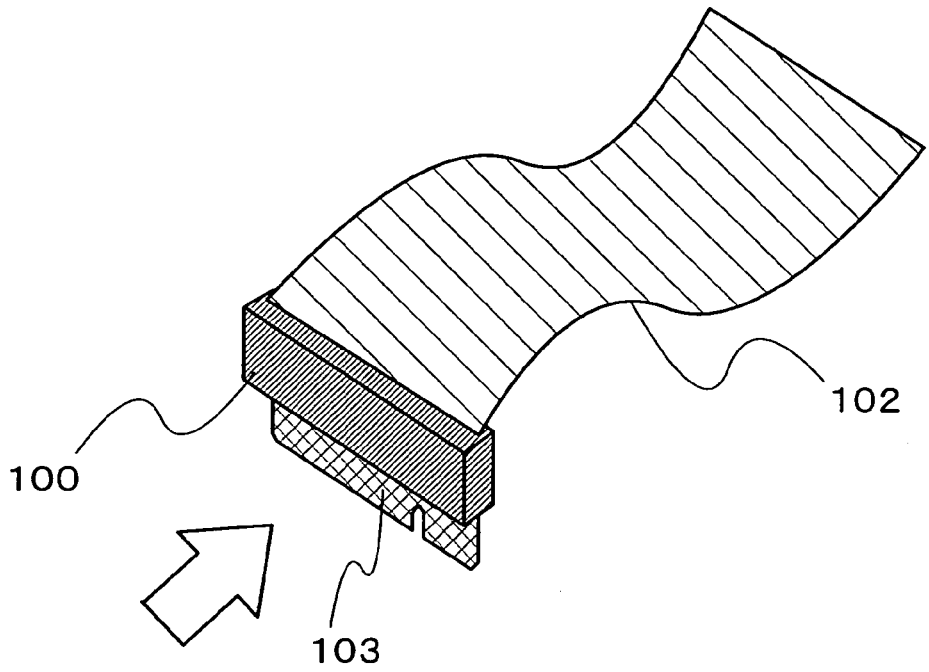
FIGS. 1A and 1B are schematic views each showing a connector of the invention.

Although the invention will be described by way of embodiment modes with reference to the accompanying drawings, it is to be understood that various changes and modifications will be apparent to those skilled in the art. Therefore, unless such changes and modifications depart from the scope of the invention, they should be construed as being included therein. Note that in all the drawings for illustrating the embodiment modes, the identical portions or portions having similar function are denoted by the same reference numerals, and description thereon is not repeated.

EMBODIMENT MODE 1

In this embodiment mode, a structure of a connector according to the invention is described with reference to FIGS. 1A to 4. Note that this embodiment mode describes, as an example, the case where a connector of the invention is connected to a printed circuit board including a wiring pattern of a PCI card edge connector; however, the invention is not limited to the PCI card.

Figure 1B:
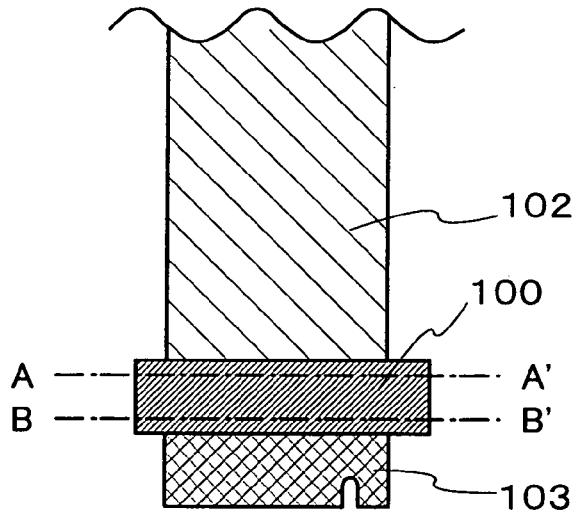

FIGS. 1A and 1B each shows the shape of a connector of the invention. FIG. 1A is a perspective view of the connector of the invention. As shown in the drawing, a flat cable 102 is electrically connected to a printed circuit board 103 in a connector 100.

FIG. 1B is a plan view of the connector of the invention seen from an arrow side in FIG. 1A. FIGS. 3A and 3B are cross sectional views along a line A-A' and a line B-B' in FIG. 1B, respectively. Note that FIGS. 2A to 2C separately show components of the connector 100 shown in FIG. 3A.

Figure 2A:
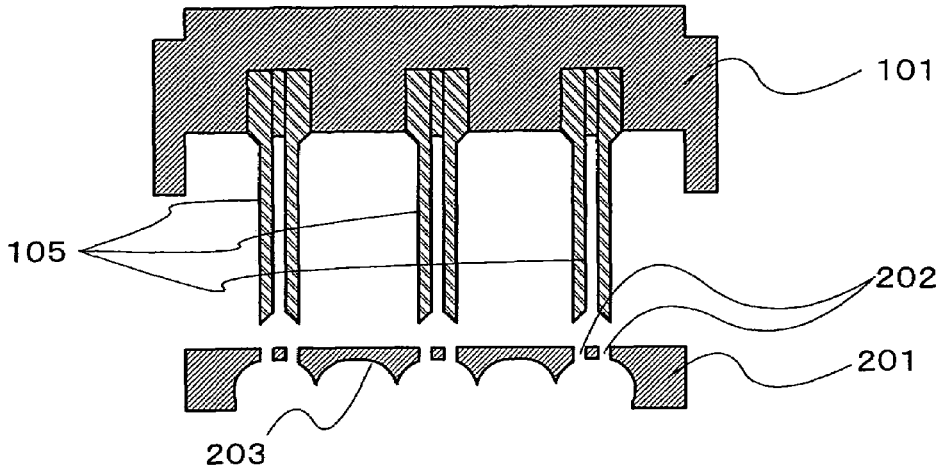
FIGS. 2A to 2C are views each showing a structure of a connector.
Figure 3A:
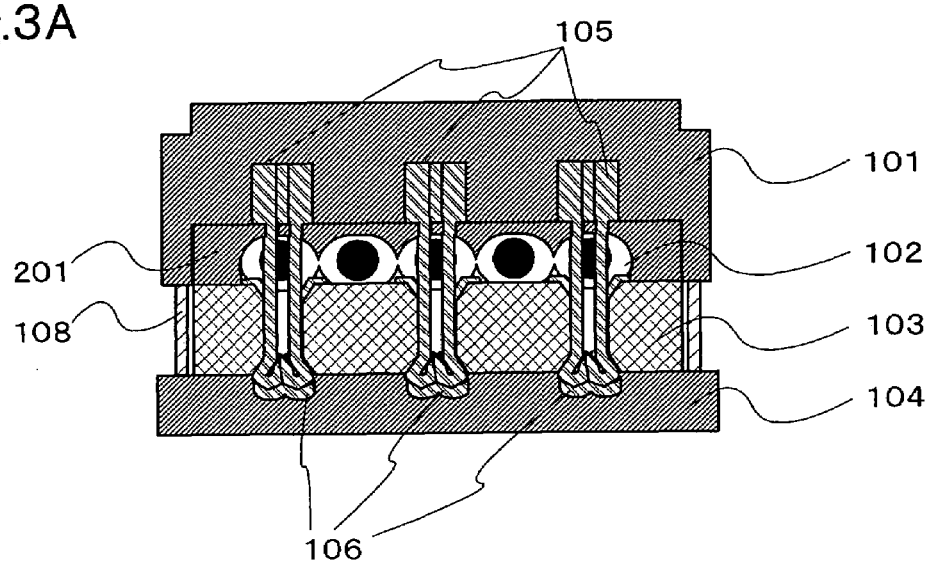
FIGS. 3A and 3B are front sectional views each showing an assembled connector.
Figure 3B:
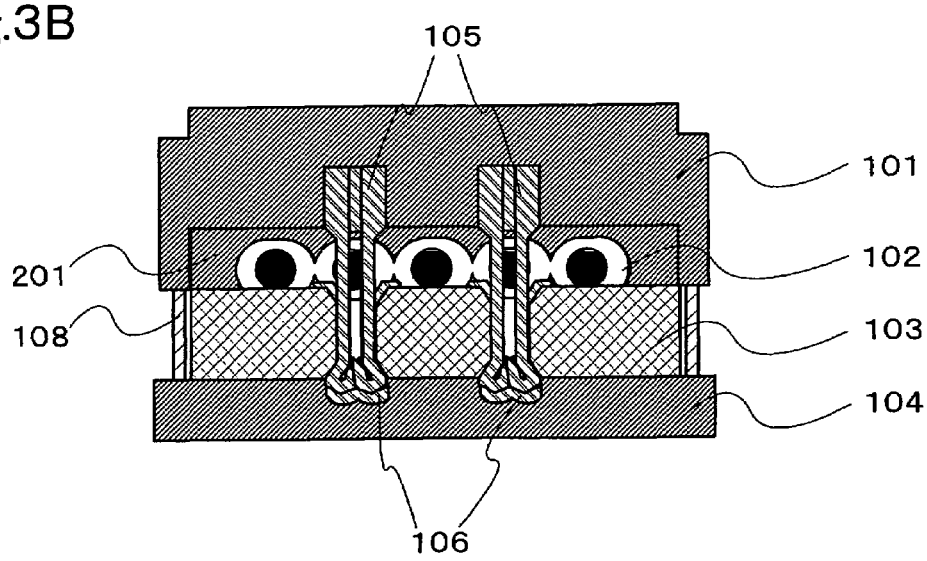

FIG. 2A shows a first housing 101, a cover 201, and first connecting terminals 105 among the components of the connector 100 according to the invention. The first housing 101 is made of a resin material and includes pockets at opposite ends. The first connecting terminals 105 provided within the first housing have a longer length than usual and pass thorough the printed circuit board. The cover 201 has holes 202 for determining the position of the first connecting terminals 105, and a depressed portion that has a wavy pattern (hereinafter referred to as a wavy surface) 203 for arranging the flat cable at a predetermined position.

The end of each of the first connecting terminals 105 is formed by punching two or three holes in a conductive metal plate or folding a conductive metal plate, in order to be crimped to a conductor 102*a* of the flat cable certainly. The end of the first connecting terminal 105 is tapered so as to pass through the flat cable and the like easily. The end of the first connecting terminal 105 shown in this embodiment mode is tapered from the outside to the inside. However, the invention is not limited to this, and the end is only required to have a shape that easily passes through the flat cable and the like.

In addition, each of the first connecting terminals 105 is arranged at a predetermined interval. The predetermined interval in the longitudinal direction of the first housing is the same as the interval of the conductor 102*a* of the flat cable. Meanwhile, in the lateral direction, the first connecting terminals 105 are arranged in zigzag or multiple rows so that adjacent connecting terminals 105 are alternately arranged.

The cover 201 has the holes 202 for holding the first connecting terminals 105. The holes 202 correspond one-to-one with the separated ends of each of the first connecting terminals 105. The holes 202 in the longitudinal direction of the cover are arranged at the same interval as the conductor 102*a* of the flat cable, and the holes 202 in the lateral direction are arranged at the same interval as the first connecting terminals 105 that are arranged in zigzag or multiple rows.

Figure 2B:
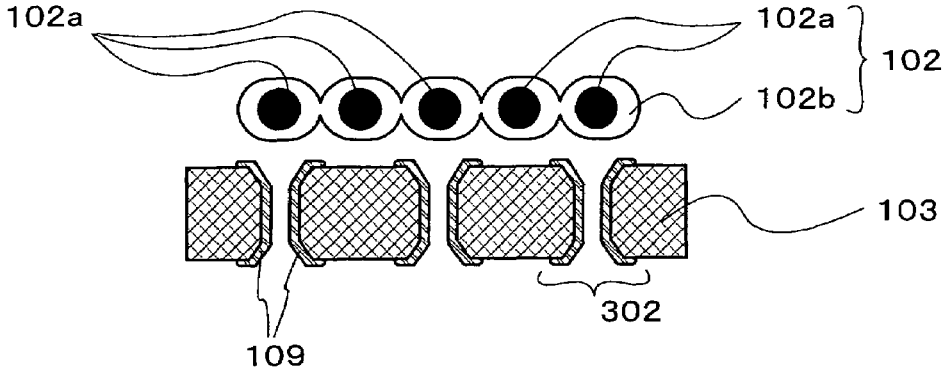

FIG. 2B shows each conductor 102*a* of the flat cable 102, an insulating coating 102*b* covering the conductors 102*a*, and the printed circuit board 103. The flat cable 102 has a structure where the conductors 102*a* are covered with the insulating coating 102*b*, and the insulating coating 102*b* is connected to each other.

The printed circuit board 103 has a through hole 302 including a copper-plated conductive portion 109, through which each of the first conductive terminals 105 passes. The through hole 302 is arranged in orthogonal to the longitudinal direction of the flat cable 102. The surface of the printed circuit board 103 is printed with a circuit pattern for connecting each through hole 302 to a PCI card edge connector corresponding to each signal. The number of the through holes 302 is equal to or more than the number of the first connecting terminals 105.

Figure 2C:
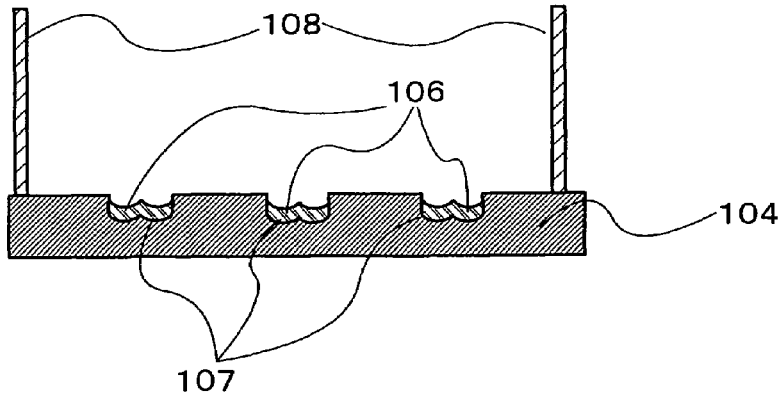

FIG. 2C shows a second housing 104. Fixing brackets 108 for fixing the connector are provided at opposite ends of the second housing 104. The fixing brackets 108 are inserted into the pockets that are provided at opposite ends of the first housing 101.

Figure 9:
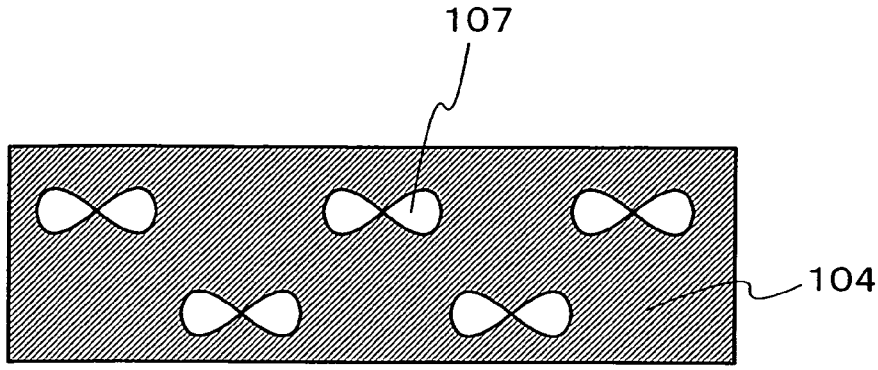
FIG. 9 is a view showing a second housing of a connector of the invention.

A plurality of depressed portions 107 for receiving the ends of the first connecting terminals 105 are provided over a surface of the second housing 104 which is in contact with the printed circuit board 103. FIG. 9 is a plan view of the second housing 104 shown in FIG. 2C, which is seen from the first housing 101 side. The depressed portions 107 over the second housing 104 have a three-dimensional droplet shape. The depressed portions 107 have, in order to receive the ends of the first connecting terminals 105 and deform them inwardly in the through hole 302, a structure where the droplet shapes are arranged so as to correspond to the separated ends of each of the first connecting terminals 105 with the tips toward the center of the through hole 302, and are cut in the horizontal direction.

The depressed portions 107 over the second housing 104 are preferably provided with guiding means 106 for guiding the direction to which each of the first connecting terminals is deformed. The guiding means 106 have a function of rolling the ends of the first connecting terminals 105. Each of the guiding means 106 has a droplet shape similarly to the depressed portions 107 over the second housing 104 shown in FIG. 9. The guiding means 106 have, in order to receive the ends of the first connecting terminals 105 and deform them inwardly in the through hole 302, a structure where the droplet shapes are arranged so as to correspond to the separated ends of each of the first connecting terminals 105 with the tips toward the center of the through hole 302, and are cut in the horizontal direction. Note that although the depressed portions 107 and the guiding means 106 each having a droplet shape are shown in FIG. 9, they may have any shape as long as they can receive the ends of the first connecting terminals 105 and deform them inwardly in the through hole 302.

Each of the guiding means 106 is formed by punching or folding a metal plate that is made of the same material as the first connecting terminals 105. Note that the metal plate is not necessarily made of the same material as the first connecting terminals 105, and may be made of a material that has such a strength that when the first connecting terminals 105 are crimped, the ends of the first connecting terminals 105 are not cut into the depressed portions 107 and can be deformed. In addition, the guiding means 106 are preferably made of a highly conductive material since the contact resistance between each conductor 102*a* of the flat cable and each through hole 302 can be reduced.

In such a connector, the first connecting terminals 105 arranged in the first housing 101 can be put in the holes 202 provided in the cover 201, and sandwich a predetermined conductor 102*a* through a part of the insulating coating 102*b* of the flat cable, so as to be crimped to the conductor 102*a*.

This embodiment mode shows an example where the surface of the printed circuit board 103 is provided with a circuit one end of which is connected to the PCI card edge connector and the other end includes the through holes 302 corresponding to the first connecting terminals 105. However, the circuit printed on the printed circuit board is not limited to this, and it is only required to provide the through holes 302 corresponding to the first connecting terminals 105 at one end. That is to say, the circuit provided at the other end of the printed circuit board 103 is not limited to the PCI card edge connector.

FIGS. 3A and 3B are described here. The first connecting terminals 105 of the connector of the invention in the longitudinal direction of the first housing are arranged at the same interval as the conductors 102*a* of the flat cable, and the first connecting terminals 105 in the lateral direction are arranged in zigzag or multiple rows. Accordingly, a cross sectional view shown in FIG. 3A or a cross sectional view shown in FIG. 3B is obtained depending on the cut position. The plurality of first connecting terminals 105 arranged in the first housing 101 pass through the holes 202 in the cover 201, and sandwich the predetermined conductor 102*a* through the insulating coating 102*b* of the flat cable, thereby being crimped to the conductor 102*a* of the flat cable. Then, when the first connecting terminals 105 are put in the depressed portions 107 over the second housing 104, the ends of the first connecting terminals 105 are deformed and crimped to the conductive portion 109 provided in the through hole 302. Accordingly, the conductor 102*a* of the flat cable and each signal of the PCI card edge connector are electrically connected to each other through each of the first connecting terminals 105.

Similarly, in the case where the guiding means 106 are provided in the depressed portions 107 over the second housing, the plurality of first connecting terminals 105 arranged in the first housing 101 pass through the holes 202 in the cover 201, and sandwich the predetermined conductor 102*a* through the insulating coating 102*b* of the flat cable, thereby being crimped to the conductor 102*a* of the flat cable. Then, when the first connecting terminals 105 are put in the depressed portions 107 over the second housing 104, the ends of the first connecting terminals 105 are deformed and brought into contact with the through hole 302 and the guiding means 106. Accordingly, the conductor 102*a* of the flat cable can be electrically connected to each signal of the PCI card edge connector through each of the first connecting terminals 105.

The guiding means 106 allow the ends of the first connecting terminals 105 to be guided to be deformed easily and safely when the ends of the first connecting terminals 105 are brought into contact with the depressed portions 107 over the second housing. Thus, the depressed portions 107 can be prevented from being damaged, and each of the first connecting terminals 105 and the through hole 302 in the printed circuit board can be electrically connected to each other certainly.

Figure 4:
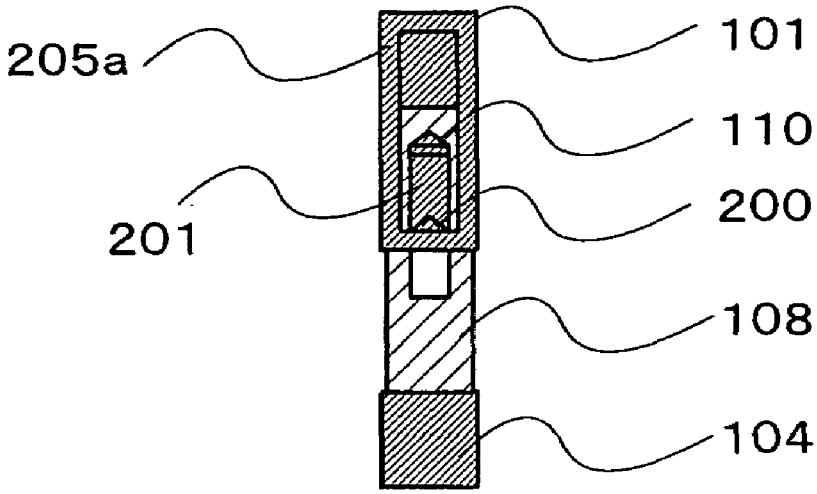
FIG. 4 is a side view showing an assembled connector.

FIG. 4 is a side view of the connector of the invention. A pocket 205*a* is provided at opposite side walls of the first housing 101, and includes a projection 110 for fixing the fixing brackets 108 when the fixing brackets 108 are inserted.

The cover 201 includes, at opposite side walls thereof, a projection 200 for temporarily fixing the fixing brackets 108 when the fixing brackets 108 are inserted.

The fixing brackets 108 provided at opposite ends of the second housing 104 are formed by punching the center of a metal plate. When the fixing brackets 108 are inserted into the pocket 205*a* provided at opposite ends of the first housing 101, the temporarily fixing projection 200 provided at opposite ends of the cover 201 is put in the punched fixing brackets 108. Thus, it is possible to temporarily fix the position of the first connecting terminals 105 in the first housing 101, the flat cable 102, the through hole 302 over the printed circuit board 103, and the depressed portions 107 over the second housing 104.

After fixing the position of the components of the connector according to the invention shown in FIGS. 2A to 2C, pressure is applied perpendicularly until a final assembly position is obtained. Then, the fixing projection 110 provided at opposite ends of the first housing 101 is put in the punched fixing brackets 108, thereby the second housing 104 is fixed in a predetermined position.

Note that the number of the first connecting terminals 105, the number of the holes 202 in the cover 201, and the number of the depressed portions 107 and the guiding means 106 in the second housing 104 are not limited to those shown in the drawings, as long as they are the same as the number of the through holes 302 over the printed circuit board 103. In addition, the number of the conductors 102*a* of the flat cable may be the same as the number of the through holes 302.

As set forth above, the connector of the invention is capable of connecting a flat cable to a printed circuit board without a receiving jig such as a socket on the circuit board side to be connected. Further, according to the invention, a flat cable and a printed circuit board can be electrically connected to each other without soldered connections. As a result, connection between a flat cable and a printed circuit board can be completed by a simple step.

EMBODIMENT MODE 2

In Embodiment Mode 1 of the invention, if data transfer drive capability might be excess or insufficient when the connector of the invention is connected to a third object to be connected, the printed circuit board 103 may include a pattern 301 capable of mounting a buffer IC, one end of which is connected to each signal of a PCI card edge connector and the other end is connected to the through hole 302 crimped to each of the first connecting terminals 105. In this embodiment mode, one mode of a layout pattern on the outermost surface of the printed circuit board 103 (on a side B of a PCI card edge connector 300) including a buffer IC is described with reference to FIG. 5.

The printed circuit board is constituted by alternately stacking a copper-plated wiring pattern and an insulating layer. For example, this embodiment mode shows the printed circuit board where a wiring pattern including the side B, an insulating layer, a ground wiring pattern, an insulating layer, a power supply wiring pattern, an insulating layer, and a wiring pattern including the side A of the PCI card edge connector are stacked in this order from the side B of the PCI card edge connector 300.

The layout of each PCI card edge connector 300 is designed to place signals based on PCI-SIG (PCI-Special Interest Group). The names of side A and side B are based on the standards of PCI-SIG, and all signals provided on both sides function as one system. For example, in the case of a system with a PCI bus width of 32 bits, the 30, 28, 26, 24, 22, 20, 18, 16, 15, 13, 11, 9, 6, 4, 2, and 0-th bits of an address/data signal, and the 0-th bit of a command/byte enable signal are arranged at predetermined positions on the side A. Meanwhile, on the side B, the 31, 29, 27, 25, 23, 21, 19, 17, 14, 12, 10, 8, 7, 5, 3, and 1-th bits of an address/data signal, and the 3, 2, and 1-th bits of a command/byte enable signal are arranged at predetermined positions.

The printed circuit board 103 includes a hole that passes through the same position of each layer so as to connect the layers. The copper-plated through hole 302 is provided at the periphery and within the hole.

In this embodiment mode, the printed circuit board 103 is printed with the PCI card edge connector 300, the through hole 302, and a wiring pattern 303 one end of which is connected to the wiring pattern including the side B of the PCI card edge connector 300 and the other end is connected to the through hole 302. Further, a signal line connected to a third object to be connected through the PCI card edge connector 300 has a pattern 301 capable of mounting a buffer IC, one end of which is connected to the PCI card edge connector 300 and the other end is connected to the through hole 302 crimped to each of the first connecting terminals 105.

Figure 5:
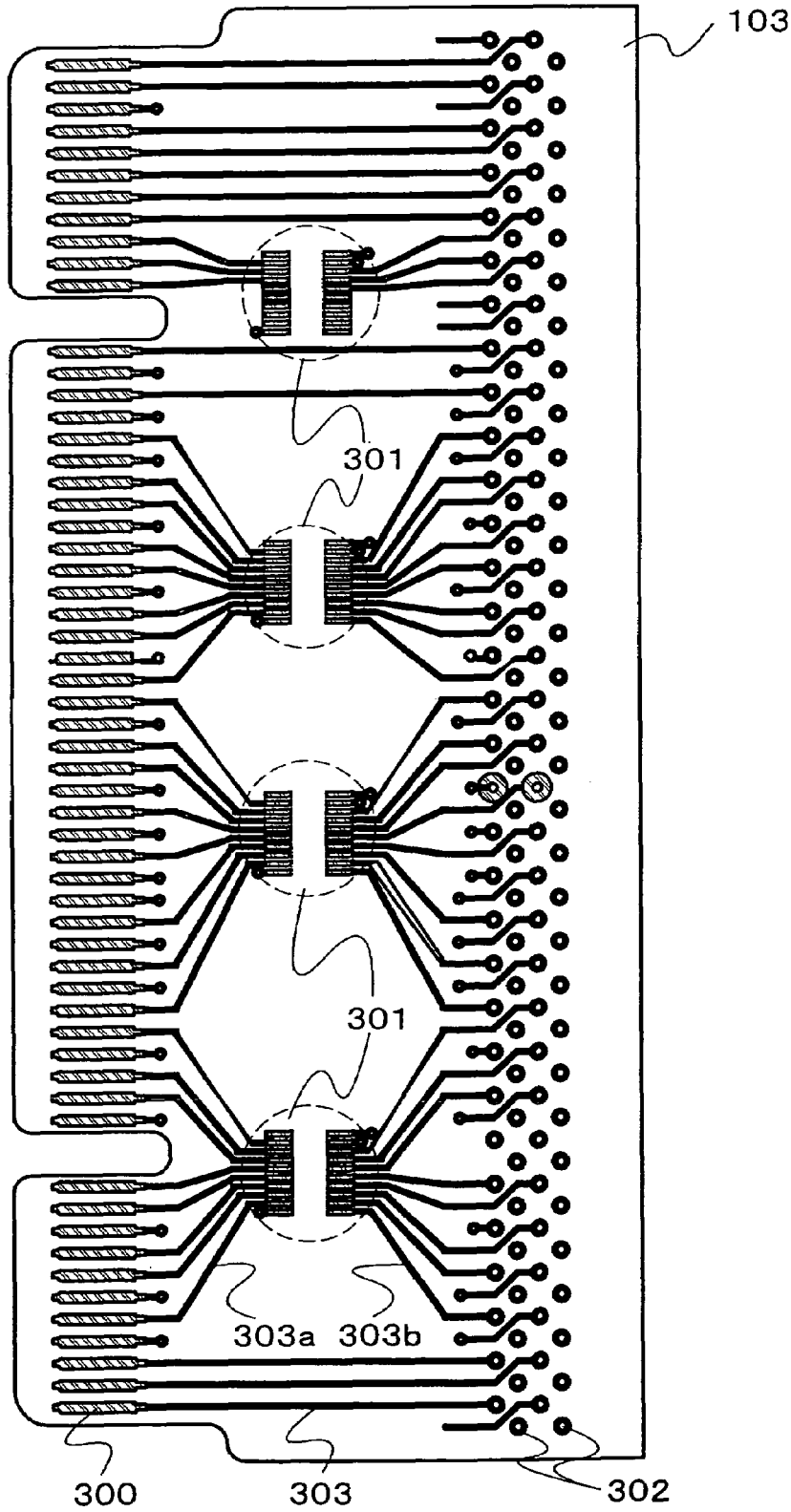
FIG. 5 is an example of a wiring pattern layout including a PCI card edge connector side B of a printed circuit board of the invention.

A wiring pattern including the side A of the PCI card edge connector is printed on the opposite surface of the printed circuit board 103 shown in FIG. 5. It is clear that as for a wiring pattern including the side A of a PCI card edge connector, wiring patterns 303, 303*a*, and 303*b* may have the same layout as FIG. 5, so that each through hole 302 is connected to the wiring pattern including the side A of the corresponding PCI card edge connector 300.

Such a printed circuit board 103 can be connected to the flat cable 102 using the first housing 101 having the connecting terminals 105 and the second housing 104. That is to say, the connector of the invention can be applied to such a printed circuit board 103. In addition, the mounted buffer IC can increase the data transfer drive capability.

EMBODIMENT MODE 3

In this embodiment mode, an overall view of a printed circuit board connected with a connector is described.

Figure 6:
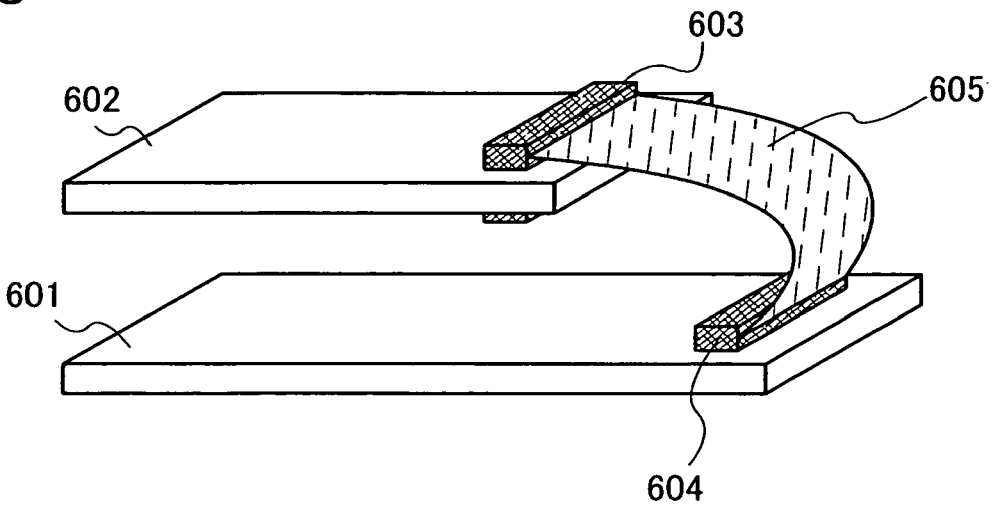
FIG. 6 is a view showing a printed circuit board connected with a connector of the invention.

FIG. 6 shows a mode where two printed circuit boards 601 and 602 are connected to each other with a flat cable 605 and connectors 603 and 604 of the invention. Each of the printed circuit boards 601 and 602 is printed with a wiring pattern of circuits having various functions. The connectors 603 and 604 of the invention can be used to electrically connect these circuits. The connector 603 has the second housing 104 while the connector 604 does not have the second housing. The second housing 104 is not necessarily provided as long as after the first connecting terminals are crimped to the through holes, the ends of the first connecting terminals are rolled and do not slip out. An opening for passing the fixing brackets 108 provided at opposite ends of the second housing 104 is required to be formed on the printed circuit board 602 where the connector 603 of the invention is connected.

This embodiment mode shows a mode where the printed circuit boards have different sizes, and the lower printed circuit board is larger than the upper printed circuit board.

Although this embodiment mode shows a mode where the printed circuit boards 601 and 602 are connected to each other using the connectors 603 and 604 of the invention, the invention is not limited to this. The printed circuit boards can be connected to each other by providing the connector of the invention on only one of the printed circuit boards.

EMBODIMENT MODE 4

This embodiment mode shows an example where a mobile phone 900 is assembled using the connector of the invention. In that case, the length of the first connecting terminals shown in the aforementioned embodiment modes is required to be reduced, and the assembly sequence shown in FIGS. 2A to 2C is reversed. Specifically, the first housing 101 is provided on the printed circuit board 103 side, and the second housing 104 is provided on an FPC (Flexible Printed Circuit) side. At this time, the depth of the depressed portions 107 in the second housing is preferably reduced. Further, it is desirable to provide the guiding means 106. The first connecting terminals 105 pass through the through holes 302 provided in the printed circuit board 103, and then the intervals of the first connecting terminals 105 are fixed by the holes 202 in the cover 201. Subsequently, the ends of the first connecting terminals 105 break through the covered FPC, and are deformed inwardly in the depressed portions of the second housing 104. Thus, the ends of the first connecting terminals 105 can be crimped to connecting pads of the FPC.

Figure 8:
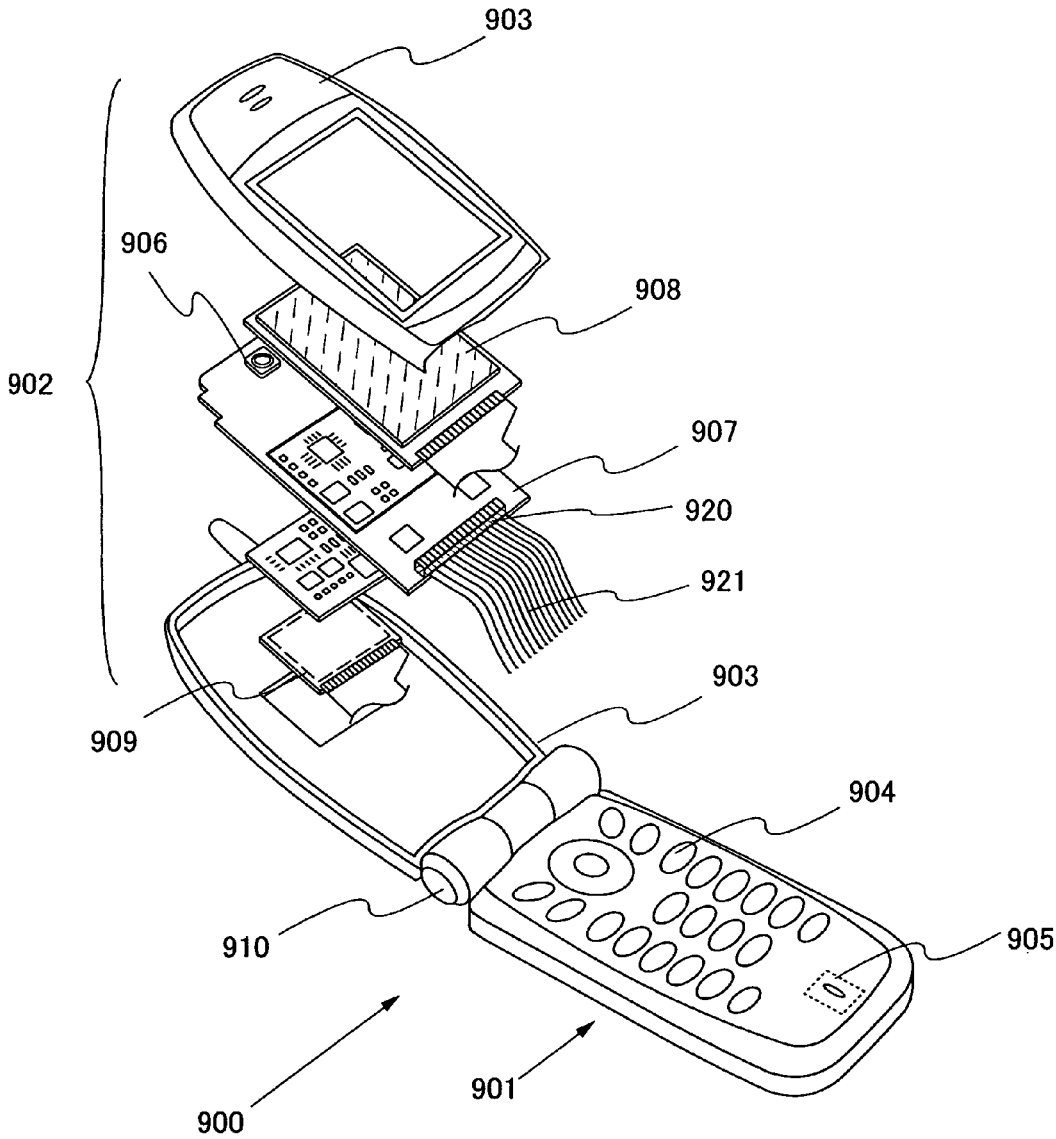
FIG. 8 is a view showing a mobile phone using a connector of the invention.

A mobile phone shown in FIG. 8 has a main body (A) 901 including an operating switch 904, a microphone 905 and the like, and a main body (B) 902 including a display panel (A) 908, a display panel (B) 909, a speaker 906 and the like. The main body (A) 901 and the main body (B) 902 are connected with a hinge 910 so as to be opened and closed. Together with a printed circuit board 907, the display panel (A) 908 and the display panel (B) 909 are put in a housing 903 of the main body (B) 902. Pixel portions of the display panel (A) 908 and the display panel (B) 909 are arranged so as to be seen from windows formed in the housing 903.

A connector 920 of the invention can be used to connect the printed circuit board 907 to a flat cable 921. The connector 920 may have the second housing 104, or may not have the second housing 104 as long as after the first connecting terminals are crimped to the through holes, the ends of the first connecting terminals are rolled and do not slip out. It is needless to say that in a thin device such as a mobile phone, the FPC is preferable to the flat cable 921 in some cases. If the flat cable is used, the connector of the invention can be used to connect the printed circuit board to the flat cable. The technical idea of the connector according to the invention can also be applied to the connection between an FPC and a printed circuit board. By adjusting the length of the first connecting terminals, specifically by reducing the length, a connector for connecting a printed circuit board to an FPC can be provided.

The specifications of the display panel (A) 908 and the display panel (B) 909, such as the number of pixels, can be appropriately determined in accordance with the function of the mobile phone 900. For example, the display panel (A) 908 can be used as a main screen and combined with the display panel (B) 909 that is used as a sub-screen.

A liquid crystal display device or a light emitting device can be applied to the display panel (A) 908. If a liquid crystal display device is used, low power consumption can be achieved. Meanwhile, if a light emitting device is used, a mobile phone with a wide viewing angle and a high response speed can be provided.

By applying such display panels, the display panel (A) 908 can be used as a color display screen with high definition for displaying character and image information, while the display panel (B) 909 can be used as a monochrome display screen for displaying character information. In particular, when an active matrix device with high definition is applied to the display panel (B) 909, the display panel (B) 909 can display various character information and display information density per screen can be increased. For example, a 2 to 2.5-inch QVGA panel (320×240 pixels) with 64 gray scales and 260000 colors is used as the display panel (A) 908, while a monochrome, high definition panel with 2 to 8 gray scales and 180 to 220 ppi is used as the display panel (B) 909 so as to display Roman characters, hiragana, katakana, Chinese characters, Arabic characters, and the like.

The mobile phone shown in this embodiment mode can have various modes depending on its function and application. For example, an image sensor may be incorporated in the hinge 910 to provide a camera phone. In addition, the operating switch 904, the display panel (A) 908, and the display panel (B) 909 may be incorporated in one housing. Alternatively, the structure of the connector according to the invention may be applied to an information display terminal having a plurality of display portions.

In such a mobile phone using the connector of the invention, connection between the flat cable and the printed circuit board can be completed by a simple step. As a result, the mobile phone can be assembled in a short time, and thus with a reduced number of components, leading to cost savings.

EMBODIMENT MODE 5

When the connector of the invention is used for opposite ends of a flat cable, printed circuit boards can be connected to each other through the flat cable. Such a connector of the invention can be applied to electronic apparatuses. Specific examples of them are described with reference to FIGS. 7A to 7E.

Figure 7A:
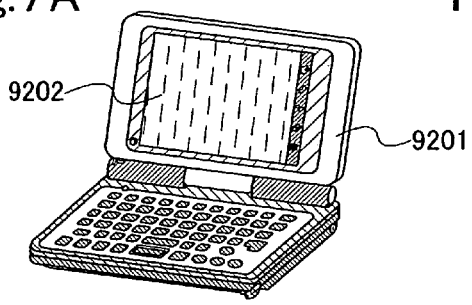
FIGS. 7A to 7E are views each showing an electronic apparatus using a connector of the invention.

A portable information terminal shown in FIG. 7A includes a main body 9201, a display portion 9202, and the like. The connector of the invention can be used to connect a printed circuit board included in the main body 9201. As a result, connection between a flat cable and the printed circuit board can be completed by a simple step. Thus, a lower cost portable information terminal can be provided.

Figure 7B:
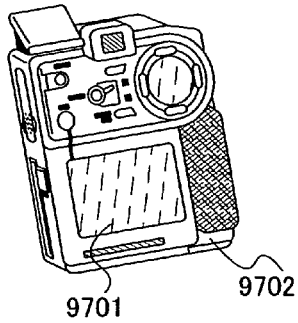

A digital video camera shown in FIG. 7B includes a display portion 9701, a main body 9702, and the like. The connector of the invention can be used to connect a printed circuit board included in the main body 9702. As a result, connection between a flat cable and the printed circuit board can be completed by a simple step. Thus, a lower cost digital video camera can be provided.

Figure 7C:
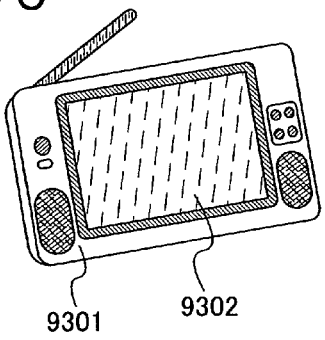

A portable television set shown in FIG. 7C includes a main body 9301, a display portion 9302, and the like. The connector of the invention can be used to connect a printed circuit board included in the main body 9301. As a result, connection between a flat cable and the printed circuit board can be completed by a simple step. Thus, a lower cost portable television set can be provided. The connector of the invention can be widely applied to various television sets such as a small size one incorporated in a portable terminal such as a mobile phone, a medium size one that is portable, and a large size one (e.g., 40 inches in size or larger).

Figure 7D:
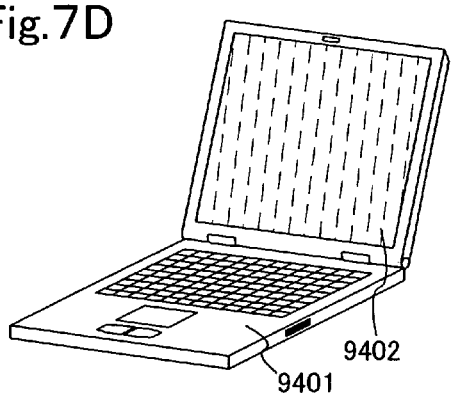

A portable computer shown in FIG. 7D includes a main body 9401, a display portion 9402, and the like. The connector of the invention can be used to connect a printed circuit board included in the main body 9401. As a result, connection between a flat cable and the printed circuit board can be completed by a simple step. Thus, a lower cost portable computer can be provided.

Figure 7E:
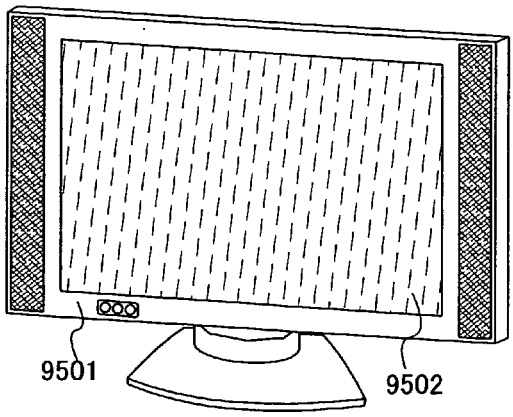

A television set shown in FIG. 7E includes a main body 9501, a display portion 9502, and the like. The connector of the invention can be used to connect a printed circuit board included in the main body 9501. As a result, connection between a flat cable and the printed circuit board can be completed by a simple step. Thus, a lower cost television set can be provided.

As set forth above, the electronic apparatuses using the connector of the invention can be provided at a lower cost. In addition, the connector of the invention allows a printed circuit board to be connected by a simple step, and the productivity can be increased.

This application is based on Japanese Patent Application serial No. 2005-126769 filed in Japan Patent Office on Apr. 25, 2005, the entire contents of which are hereby incorporated by reference.

What is claimed is:

1. A connector comprising:

a first housing including a first connecting terminal;

a second housing including a depressed portion for receiving an end of the first connecting terminal; and a cover including a hole for holding the first connecting terminal, wherein the first connecting terminal is capable of being electrically connected to one of a plurality of conductors covered by an insulating coating and arranged in parallel with each other along a longitudinal direction of a flat cable, wherein the first connecting terminal is capable of sandwiching one of the plurality of conductors through the insulating coating of the flat cable and of crimping one of the plurality of conductors, wherein the second housing comprises a guiding means for guiding a direction to which the first connecting terminal is deformed, and wherein the guiding means includes a conductive material.

2. The connector according to claim 1, wherein the cover includes a wavy pattern for arranging the flat cable therein.

3. A connector comprising:

a first housing including a plurality of first connecting terminals;

a second housing including a plurality of depressed portions for receiving ends of the first connecting terminals; and a cover including holes for holding the first connecting terminals, wherein the first connecting terminals are capable of being electrically connected to at least one of a plurality of conductors covered by an insulating coating and arranged in parallel with each other along a longitudinal direction of a flat cable, wherein the first connecting terminals are capable of sandwiching the plurality of conductors through the insulating coating of the flat cable and of crimping the plurality of conductors, wherein the first connecting terminals are provided in a longitudinal direction of the first housing, wherein the second housing comprises a guiding means for guiding a direction to which the first connecting terminals are deformed, and wherein the guiding means includes a conductive material.

4. The connector according to claim 3, wherein the guiding means prevents the depressed portions from being damaged by the ends of the first connecting terminals when the first connecting terminals are put in the second housing.

5. The connector according to claim 3, wherein the longitudinal direction of the first housing is orthogonal to the longitudinal direction of the flat cable.

6. The connector according to claim 3, wherein the cover includes a wavy patern for arranging the flat cable therein.

7. A connector comprising:

a first housing including a plurality of first connecting terminals;

a second housing including a plurality of depressed portions for receiving ends of the first connecting terminals; and a cover including holes for holding the first connecting terminals, wherein the first connecting terminals are capable of being electrically connected to at least one of a plurality of conductors covered by an insulating coating and arranged in parallel with each other along a longitudinal direction of a flat cable, wherein the first connecting terminals are capable of sandwiching the plurality of conductors through the insulating coating of the flat cable and of crimping the pluarality of conductors, wherein the first connecting terminals are provided in a longitudinal direction of the first housing, and wherein the first connecting terminals are deformed in the depressed portions of the second housing to be in contact with a conductive portion of a printed circuit board, thereby the conductive portion of the printed circuit board is electrically connected to the conductors of the flat cable crimped to the first connecting terminals.

8. The connector according to claim 7, wherein the second housing comprises a guiding means for guiding a direction to which the first connecting terminals are deformed.

9. The connector according to claim 8, wherein the guiding means prevents the depressed portions from being damaged by the ends of the first connecting terminals when the first connecting terminals are put in the second housing.

10. The connector according to claim 7, wherein the longitudinal direction of the first housing is orthogonal to the longitudinal direction of the flat cable.

11. The connector according to claim 7, wherein the cover includes a wavy pattern for arranging the flat cable therein.

12. The connector according to claim 7, wherein the first connecting terminals have a length equal to or longer than a thickness of the printed circuit board.

13. A connector comprising:

a first housing including a first connecting terminal arranged at a first surface;

a second housing including a depressed portion for receiving an end of the first connecting terminal at a second surface; and a cover including a hole for holding the first connecting terminal, wherein the first surface of the first housing and the second surface of the second housing are faced to each other with the cover interposed therebetween, wherein the second housing comprises a guiding means for guiding a direction to which the first connecting terminals are deformed, and wherein the guiding means includes a conductive material.

14. The connector according to claim 13, wherein the end of the first connecting terminal has tapered form.

15. The connector according to claim 13, wherein the first housing includes a resin material.

16. A connector comprising:

a first housing including a plurality of first connecting terminals arranged at a first surface;

a second housing including a plurality of depressed portions for receiving ends of the first connecting terminals at a second surface; and a cover including holes for holding the first connecting terminals, wherein the first connecting terminals are provided in a longitudinal direction of the first housing, wherein the first connecting terminals are provided at an equal interval, wherein the first surface of the first housing and the second surface of the second housing are faced to each other with the cover interposed therebetween, wherein the second housing comprises a guiding means for guiding a direction to which the first connecting terminals are deformed, and wherein the guiding means includes a conductive material.

17. The connector according to claim 16, wherein ends of the first connecting terminals have tapered form.

18. The connector according to claim 16, wherein the first connecting terminals are arranged in zigzag or multiple rows.

19. The connector to claim 16, wherein the first housing includes a resin material.

20. The connector according to claim 16, wherein each of the depressed portions has a three-dimensional droplet shape.

21. The connector according to claim 16, wherein the second housing comprises fixing brackets for fixing the first connecting terminals provided at opposite ends thereof.

22. The connector according to claim 21, wherein the first housing includes a projection for fixing the fixing brackets when the fixing brackets are inserted.

23. The connector according to claim 16, wherein each of the guiding means includes the same material as the first connecting terminals.

24. The connector according to claim 16, wherein each of the guiding means has a droplet shape.

25. A connector comprising:

a first housing including a first connecting terminal arranged at a first surface;

a second housing including a portion for receiving an end of the first connecting terminal at a second surface; and a cover including a hole for holding the first connecting terminal, wherein the first surface of the first housing and the second surface of the second housing are faced to each other with the cover interposed therebetween, wherein the second housing comprises a guiding means for guiding a direction to which the first connecting terminal is deformed, and wherein the guiding means includes a conductive material.

26. The connector according to claim 25, wherein the guiding means has a droplet shape.

27. A connector comprising:

a first housing including a plurality of first connecting terminals;

a second housing including a plurality of depressed portions for receiving ends of the first connecting terminals; and a cover including holes for holding the first connecting terminals, wherein the first connecting terminals are capable of being electrically connected to at least one of a plurality of conductors covered by an insulating coating and arranged in parallel with each other along a longitudinal direction of a flat cable, wherein the first connecting terminals are capable of sandwiching the plurality of conductors through the insulating coating of the flat cable and of crimping the plurality of conductors, wherein the first connecting terminals are provided in a longitudinal direction of the first housing, wherein the second housing comprises a guiding means for guiding a direction to which the first connecting terminals are deformed, wherein the guiding means includes a conductive material, and wherein each of the depressed portions has a three-dimensional droplet shape.

28. The connector according to claim 27, wherein ends of the first connecting terminals have tapered form.

* * * * *

UNITED STATES PATENT AND TRADEMARK OFFICE

CERTIFICATE OF CORRECTION

PATENT NO. : 7,291,038 B2
APPLICATION NO. : 11/405515
DATED : November 6, 2007
INVENTOR(S) : Asami Tadokoro It is certified that error appears in the above-identified patent and that said Letters Patent is hereby corrected as shown below:

Col. 13, line 61, replace “terminals are” with --terminal is--.

Signed and Sealed this

First Day of April, 2008

JON W. DUDAS
*Director of the United States Patent and Trademark Office*